US006036712A

United States Patent [19]

Blomdahl

[11] Patent Number: 6,036,712

[45] Date of Patent: Mar. 14, 2000

[54] EAR PIERCING APPARATUS

[75] Inventor: Karl Blomdahl, Halmstad, Sweden

[73] Assignee: Blomdahl Medical, Sweden

[21] Appl. No.: 09/287,388

[22] Filed: Apr. 6, 1999

Related U.S. Application Data

[62] Division of application No. 09/012,798, Jan. 26, 1998, Pat. No. 5,925,057.

[51] Int. Cl.[7] ..... A61B 17/34

[52] U.S. Cl. ..... 606/188

[58] Field of Search ..... 606/188, 181, 606/185, 182

[56] References Cited

U.S. PATENT DOCUMENTS 4,943,294 7/1990 Knapp ..... 606/188
5,709,700 1/1998 Hirota ..... 606/188
5,913,869 6/1999 Reil ..... 606/188

*Primary Examiner*—Michael Buiz
*Assistant Examiner*—Kevin Truong
*Attorney, Agent, or Firm*—Fasth Law Offices; Rolf Fasth

[57] ABSTRACT

The ear piercing apparatus comprises a clutch assembly that is slidably attached to apparatus to ensure that an attachment position of a clutch on the piercing pin is adjusted to the thickness of the ear. The position of the clutch assembly may be locked prior to ejecting the piercing pin into the clutch. The ear piercing apparatus includes an ear piercing pin having an enlarged head portion. The enlarged portion is tailored to the shape of the inside of an openable holder device so that the head portion is firmly held within the holder device during the piercing of an ear. The front portion of the holder device is opened by a chamfered edge disposed on a clutch assembly. A pair of jaw members of the holder device may engage the chamfered edge to open the jaw members.

11 Claims, 5 Drawing Sheets

EAR PIERCING APPARATUS

PRIOR APPLICATION

This is a divisional application of U.S. patent application Ser. No. 09/012,798, filed Jan. 26, 1998, now U.S. Pat. No. 5,925,057.

TECHNICAL FIELD

The present invention is an ear piercing apparatus for piercing holes in ears.

BACKGROUND INFORMATION AND SUMMARY OF THE INVENTION

This invention is directed to an ear piercing apparatus for making ear piercing safer and easier for both consumers and practitioners. More particularly, the ear piercing apparatus of the present invention permits an automatic and exact adjustment of the attachment position of the clutch on the piercing pin. The present invention provides for a consistent, efficient, and safe method for piercing ears with a variety of delicate and fragile ear piercing pins.

In some prior art ear piercing apparatuses, the piercing is dependent on the hand strength of the operator. The operator has to push the piercing pin through the ear and into the clutch. Preferably, the piercing pin should be pushed exactly as far into the clutch as to accommodate the thickness of the ear being pierced. In other words, the difficult task of positioning the clutch on the piercing pin is left entirely to the practitioner.

In other prior art ear piercing apparatuses, no matter how thick or thin the pierced ear might be, the clutch is placed on the same fixed position on the piercing pin. The problems associated therewith are either left to the customer to endure, or an adjustment of the clutch position is carried out manually after the actual piercing of the ear.

Some of the above described prior art ear piercing apparatuses allow the clutch to be adjusted manually after the ear piercing has taken place. If the customer, who lacks experience in ear piercing procedures, carries out this adjustment himself/herself, there is an obvious risk of infecting the wound or placing the clutch at an incorrect position. If, on the other hand, the practitioner repositions the clutch with his/her bare hands, he/she runs a risk of getting into contact with the customer's blood, which may contain a life-threatening blood virus. The fact that the point of the piercing pin may be "needle sharp" does not make the procedure less hazardous.

The present invention provides for an automatic and exact piercing process that permits the use of fragile piercing pins, such as pins made from pure gold. The head portion of the piercing pin is firmly held within a disposable cartridge and the push rod of the apparatus ejects a holder device towards the clutch so that the piercing pin is firmly held within the holder device until a pair of jaws of the holder device are allowed to open to release the piercing pin including its head portion. The clutch is automatically and correctly positioned on the piercing pin when the piercing pin is ejected through the ear and into the clutch because the piercing apparatus of the present invention has an adjustment mechanism that adjusts the position of the clutch assembly to the thickness of the ear. The correct position of the clutch on the piercing pin is an important feature because if the ear is thin and the clutch is attached too far out on the piercing pin then there is a risk that the head portion of the piercing pin is hanging with increased risk for infection of the ear. If the ear is thick and the clutch is attached too far in on the piercing pin then there is a risk that the ear is slow to heal due to lack of air in the hole of the ear. The adjustment mechanism of the present invention overcomes these deficiencies. The ear piercing apparatus of the present invention provides for a fast, consistent, simple, and safe way of piercing an ear.

Detailed Description

Figure 1:
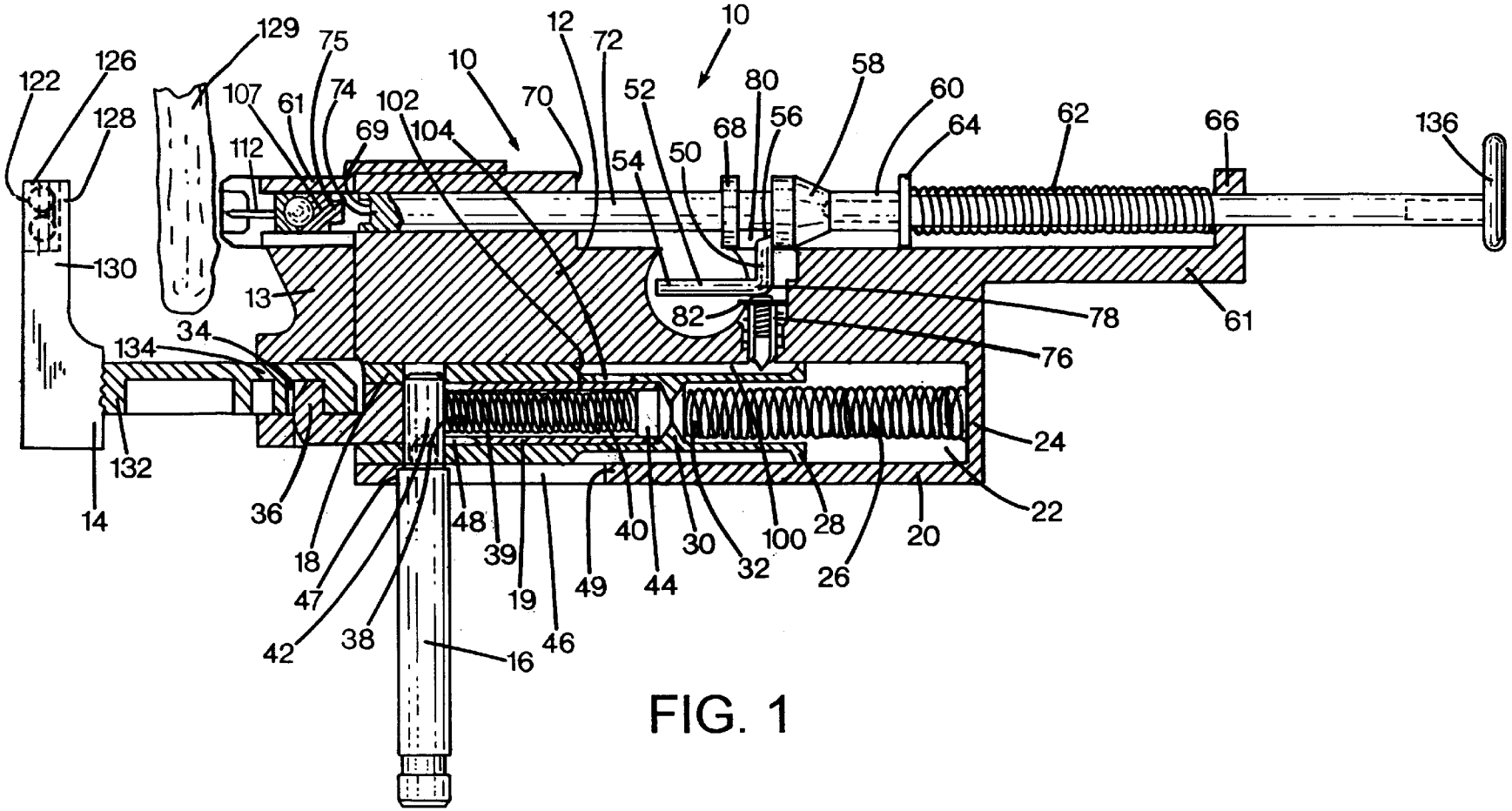
FIG. 1 is a side view of the ear piercing apparatus of the present invention showing the ear piercing apparatus in an opened position.

With reference to FIGS. 1–5, the ear piercing apparatus 10 of the present invention includes a cartridge housing 12 and a disposable piercing pin and clutch cassette assembly 13 (best seen in FIGS. 2 and 5) that is releasably attached to the cartridge housing 12 so that the cassette assembly 13 can be snapped onto the cartridge housing 12 and conveniently removed from the cartridge housing 12 when the cassette assembly 13 is no longer needed. It is to be understood that the assembly 13 may be a non-disposable and/or non-releasable assembly. The cassette assembly 13 is preferably provided in a sealed and sterile casing prior to attaching the cassette assembly to the cartridge housing 12. The cassette assembly 13 of the ear piercing apparatus 10 includes a slidable clutch assembly 14 that is slidably movable between an open and a closed position. A control member such as an elongate cylindrical handle 16 (see FIGS. 1 and 3) is secured to an elongate rod member 18 that may be inserted into the cartridge housing 12. A hollow cylindrical member 19 is slidably disposed within the rod member 18. In the preferred embodiment, the member 19 is movable within the rod member 18. The member 19 may also be a solid member, have a non-cylindrical shape, and be movable outside the rod member 18. The clutch assembly 14 is attached to the cylindrical member 19 so that the clutch assembly is movable relative to the cartridge housing 12, as explained in detail below.

The handle 16 extends downwardly and outwardly from a bottom portion 20 of the cartridge housing 12. The handle 16 is adapted to move the clutch assembly 14 relative to the cartridge housing 12. The rod member 18 may be disposed inside a rod receiving channel 22 defined at the bottom portion 20 of the cartridge housing 12. The channel 22 terminates at a back wall 24 of the cartridge housing 12.

A second spring 26 may be inserted into a back portion 28 of the rod member 18. The second spring 26 extends between the back wall 24 and a stopper section 30 that is disposed inside a spring receiving cavity 32 defined at the back portion 28 of the rod member 18. In this way, the spring 26 is biasing the rod member 18 away from the back wall 24 of the cartridge housing 12.

The rod member 18 defines a cavity enclosure 38 at a front end portion of the rod member 18 to receive the cylindrical member 19. The cylindrical member 19 is slidably engaging the rod member 18 so that the cylindrical member 19 is movable relative to both the rod member 18 and the handle 16.

The clutch assembly 14 has an attachment cavity 34 defined therein for receiving an engagement member 36 that is attached to the front end portion of the cylindrical member 19. The engagement member 36 extends upwardly and into the cavity 34 so that the clutch assembly 14 is releasably attached to the cylindrical member 19.

The cylindrical member 19 has a chamber 39 defined inside the cylindrical member 19 for holding a first spring 40 that extends between an upper portion 42 of the handle 16 and a back portion 44 of the cylindrical member 19. The first spring 40 is biasing the handle 16 relative to the back portion 44.

The bottom portion 20 has a slit opening 46 defined therein so that the handle 16 may travel within the slit opening 46 and move relative to the cartridge housing 12. The slit opening has a front edge 47 and a back edge 49. The cylindrical member 19 has a handle receiving opening 48 defined therein that is adapted to receive the upper portion 42 of the handle 16 so that the handle 16 may also be moved within the opening 48 relative to the cylindrical member 19 to compress the first spring 40. In this way, the handle 16 may extend through both the slit opening 46 and the opening 48. As explained in detail below, the handle 16 only moves within the opening 48 relative to the cylindrical member 19 when the clutch assembly 14 is in a closed position to accommodate for a variety of ear thickness when an ear is positioned within the cassette assembly 13. This ensures that a clutch 122 is attached at the right position to an ear piercing pin 112 that is disposed within the cassette assembly 13.

When the handle 16 is moved from the front edge 47 towards the back edge 49 of the slit opening 46, the spring 40 is not compressed as long as the clutch positioning device 130 is not encountering the ear. As soon as the clutch positioning device 130 hits the ear, the positioning device 130 stops moving and the spring 40 may be compressed as the handle 16 is moved to the back edge 49 of the slit opening 46, as explained further below.

An ejection mechanism 50 (see FIGS. 1, 3 and 4) is disposed inside the cartridge housing 12. The ejection mechanism 50 includes an ejector pin 52 that has a horizontal trigger portion 54 in a clockwise direction and a vertical engagement portion 56 so that the trigger portion 54 is substantially perpendicular to the engagement portion 56.

The engagement portion 56 may engage a front section of a large diameter head section 58 of an elongate push rod assembly 60 that is disposed at an upper portion 61 of the cartridge housing 12. The push rod assembly 60 may include a third spring 62 that is biasing the push rod towards the cassette assembly 13. The push rod assembly 60 may be loaded against the biasing force of the third spring 62 by pulling the push rod assembly 60 away from the cassette assembly 13 until the engagement portion 56 engages the head section 58 to lock the push rod assembly 60 in the loaded position (best shown in FIG. 1). When the push rod assembly 60 is in the loaded position, the third spring 62 may be compressed between stopper members 64 attached to the push rod assembly 60 and a stopper member 66 attached to the cartridge housing 12. The push rod assembly 60 may be released by pulling the trigger portion 54 towards the push rod assembly 60 so that the engagement portion 56 moves backwardly and downwardly until the engagement portion 56 disengages the head portion 58 and the push rod assembly 60 is free to eject forwardly by the compressed third spring 62. The push rod assembly 60 moves in a forward direction until a forward stopper portion 68 of the push rod assembly 60 hits a stop wall 70 of the cartridge housing. An outer end of a small diameter rod member 72 may have a cavity 69 defined therein. When the push rod assembly 60 is ejected, the small diameter rod member 72 of the push rod assembly 60 may be ejected into a channel 74 defined in the cartridge housing 12 to engage a protruding rear portion 75 of a holder device 107.

Figure 4:
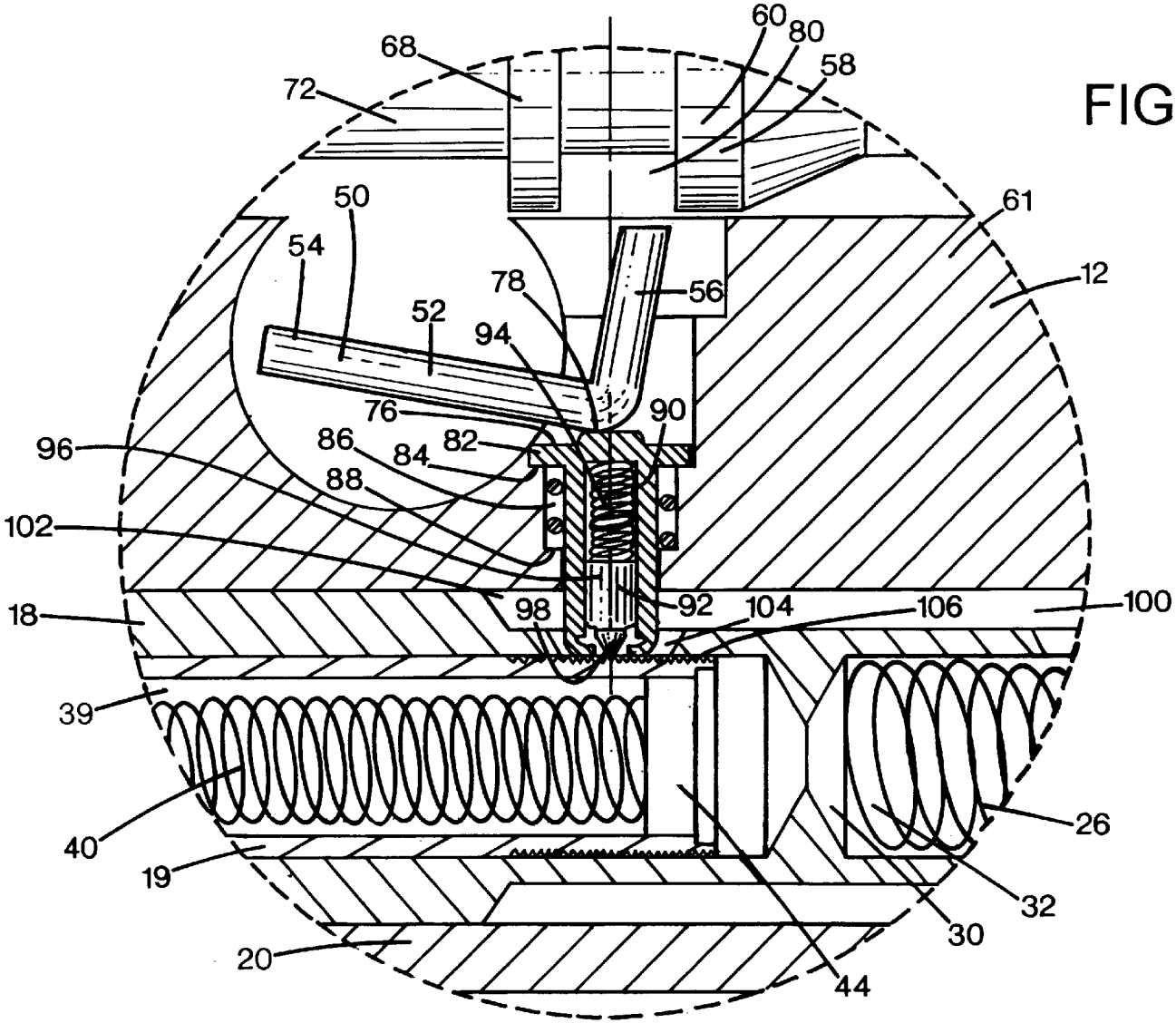
FIG. 4 is a enlarged detail view of the locking mechanism of the present invention.

As best seen in FIG. 4, the ejector pin 52 is biased upwardly towards the push rod assembly 60 by a spring biased locking mechanism 76. The locking mechanism 76 engages the ejector pin 52 so that the ejector pin 52 is biased against the push rod assembly 60 into a cavity 80 defined between the forward stopper 68 and the head section 58. In this way, the engagement portion 56 is urged into the cavity 80 to safely hold the push rod assembly 60 in the loaded position.

The locking mechanism 76 has an upper flange 82 that is resting against a shelf 84 defined in the cartridge housing 12. The locking mechanism 76 is biased upwardly towards the ejector pin 52 by a fourth spring 86 that is captured between the upper flange 82 and a lower shelf 88 defined in the cartridge housing 12 below the shelf 84. A pocket 90 is defined inside the locking mechanism 76 to receive a movable pointer member 92. The pointer member 92 has a reduced diameter section for holding a fifth spring 94 that is captured between the upper flange 82 and a large diameter section 96 of the pointer member 92 so that the pointer member 92 is biased away from the upper flange 82 in a downward direction.

The pointer member 92 has a pointer 98 attached to the large diameter section 96. The pointer 98 extends into an opening 100 defined by the rod member 18. The opening 100 may be very wide compared to the locking mechanism 76. Adjacent a front end 102 of the opening 100 is an inner opening 104 defined by the bar member 18 so that a threaded portion 106 of the cylindrical member 19 is exposed. The cylindrical member 19 may be disposed inside the chamber 38 and is movable relative to the rod member 18. This is an important feature that is explained in detail below.

Figure 2:
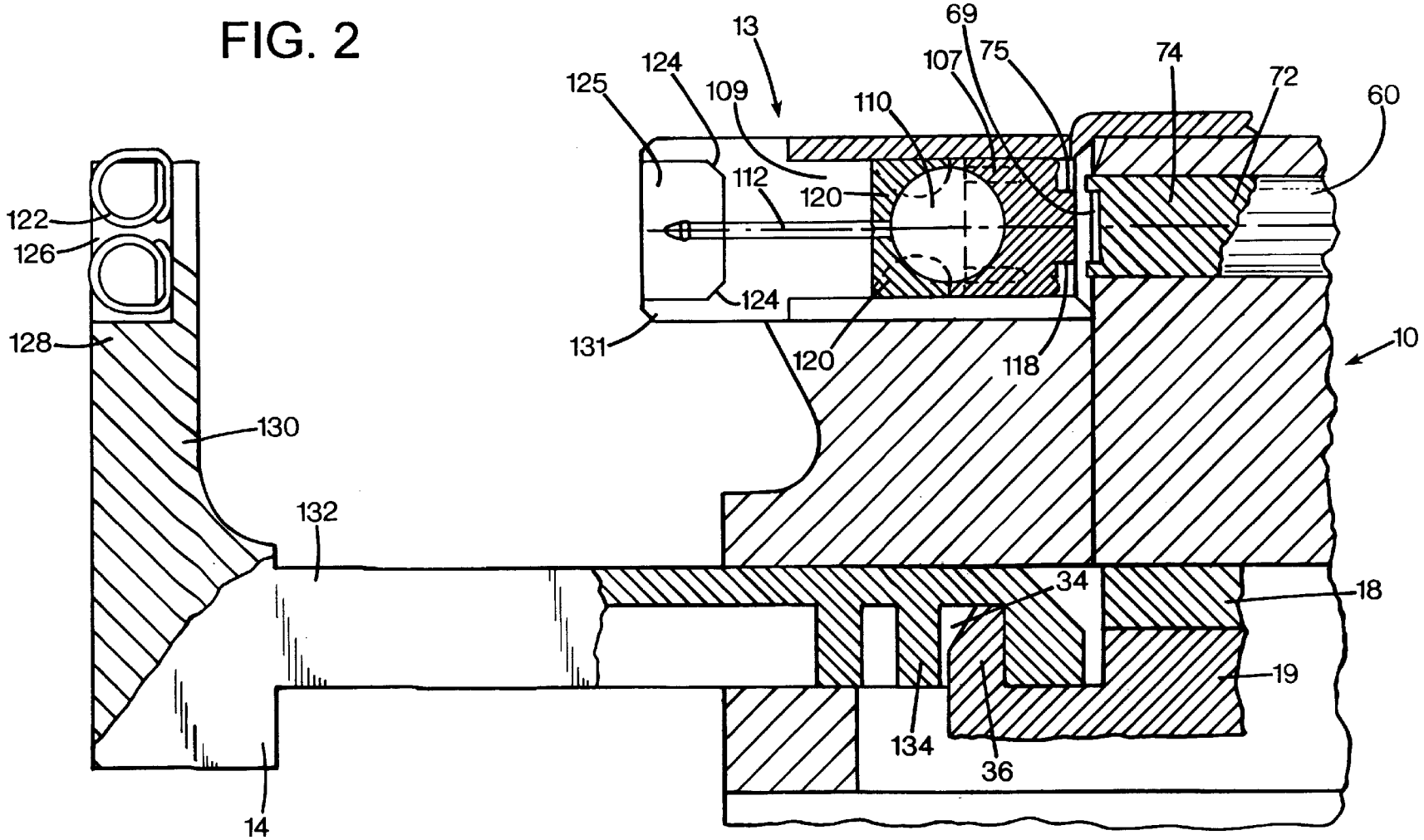
FIG. 2 is a side view of a portion of the ear piercing apparatus of the present invention showing a holder device in an opened position.
Figure 3:
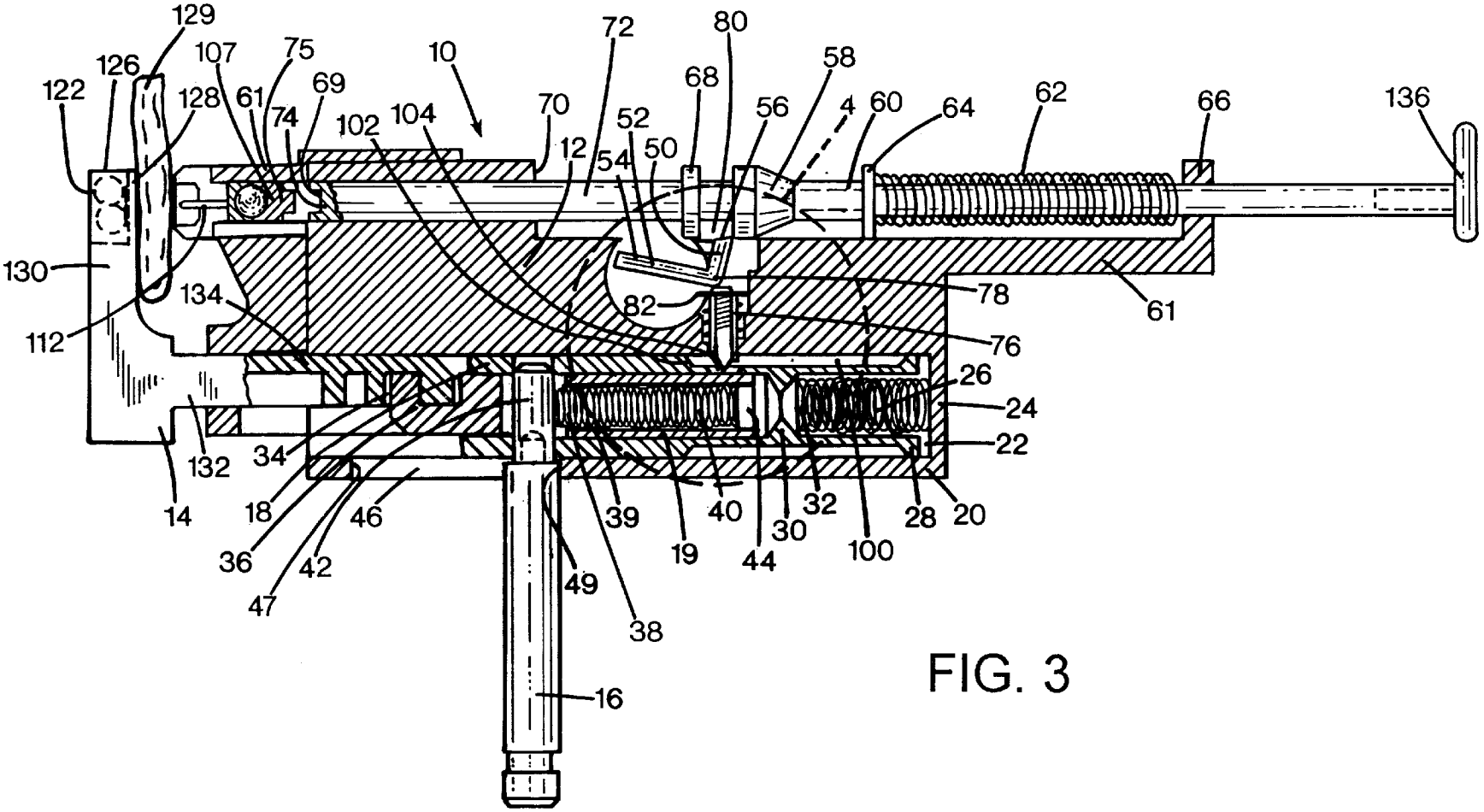
FIG. 3 is a side view of the ear piercing apparatus of the present invention showing the ear piercing apparatus in an closed position.
Figure 5:
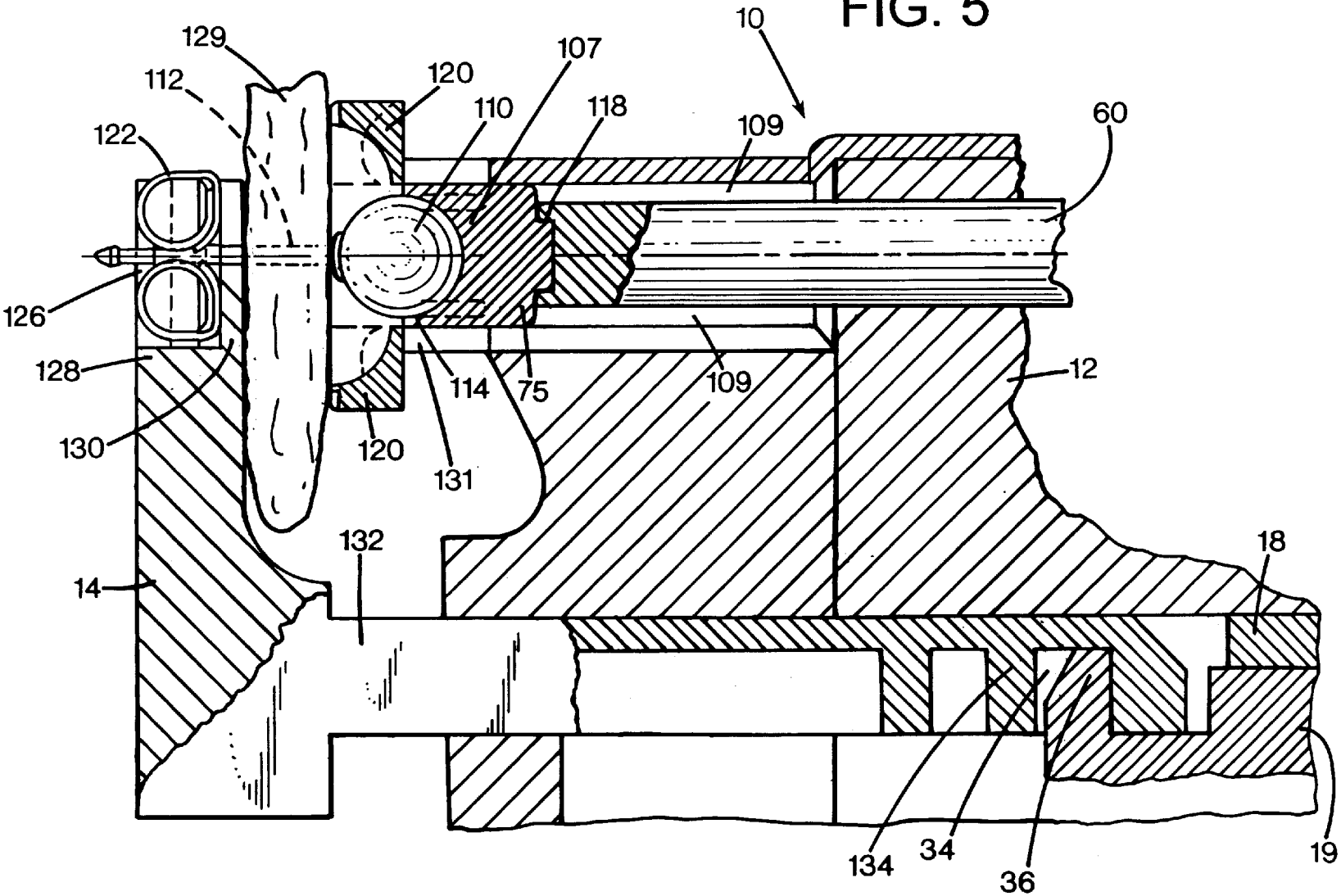
FIG. 5 is a side view of a portion of the ear piercing apparatus of the present invention showing a holder device in a closed position.

As best seen in FIGS. 2 and 5, the cassette assembly or cartridge 13 includes the movable holding device 107 that is adapted to hold an enlarged portion 110 of the ear piercing pin 112. The holding device 107 is disposed in a chute 109 defined in the cartridge 13. The holding device 107 has a front portion 114 and the rear portion 75. The rear portion 75 includes a protruding push rod engaging section 118 and the front portion 114 has a pair of jaws 120 that are movable between a closed position (as shown in FIG. 2) and an open position (as shown in FIG. 5). The enlarged portion 110 is firmly held inside the holding device 107 when the jaws 120 are in the closed position and the enlarged portion is releasably held within the cassette when the jaws 120 are in the open position. As described below, the jaws may be opened when the jaws hit the jaw engaging surfaces 124 attached to a protruding member 125. The surfaces 124 are chamfered to engage and force the jaws 120 to open when the jaws hit the surfaces 124 after the push rod assembly 60 is released so that the rod member 72 is ejected towards the holding device 107 to push the holding device 107 until the jaws encounters the chamfered surfaces 124.

The clutch assembly 14 releasably supports the clutch 122 that is disposed in a pocket 126 defined at an upper portion 128 of the clutch assembly 14. The clutch 122 is adapted to engage and hold the ear piercing pin 112 when the rod member 72 pushes the holding device 107 with the ear piercing pin 112 disposed therein towards the clutch 122.

The clutch assembly 14 further includes the movable clutch positioning device 130 that is movable from a first open position (as shown in FIG. 2) to a second position (as shown in FIG. 5) to engage an earlobe 129 against a stationary portion 131 of the cartridge 13 when the clutch positioning device 130 is in the second position. When the clutch positioning device 130 is in the open position, a floor section 132 extends between the clutch positioning device 130 and the stationary portion 131. The floor section 132 has a length much longer than the thickness of ears so that ears may conveniently be placed between the clutch positioning device 130 and the stationary portion 131 when the clutch positioning device is in the open position. An outer end 134 of the floor section 132 has the cavity 34 formed therein that may be attached to the engagement member 36 (see FIGS. 1 and 3) so that the floor section 132 is movable together with the cylindrical member 19 that may be disposed within the rod member 18.

In operation, the push rod assembly 60 is loaded by pulling back a protruding handle 136 against the biasing force of the third spring 62 until engagement portion 56 slides over the head section 58 and snaps into the cavity 80 since the engagement portion 56 is biased upwardly by the fourth spring 86. When the engagement portion 56 is snapped into the cavity 80, the push rod assembly 60 is locked in the loaded position. The cassette assembly 13 is then snapped into the cartridge housing 12, and the operator removes the protective cover (not shown) from the cassette assembly 13.

The ear 129 placed in between the clutch positioning device 130 and the stationary portion 131 of the cassette assembly 13 is held against stationary portion 131 by pulling the handle 16 rearwardly within the slit opening 46. As a result of pulling the handle 16, the clutch positioning device 130 moves towards the stationary portion 131 against the biasing force of the spring 26 until the ear 129 hits or engages the stationary portion. When the ear 129 is being engaged, the handle 16 is in an intermediate position between the front edge 47 and the back edge 49. In particular, the handle 16 may be continued to be pulled within the slit opening 46 until the handle 16 engages the back edge 49 of the slit opening 46. In the preferred embodiment, this extra engaging movement of the handle 16 only marginally increases the engaging pressure of the ear 129 because the handle 16 is only compressing the relatively weak first spring 40 so that the handle 16 is moved relative to the cartridge housing 12 but the clutch assembly 14 and thus the clutch positioning device 130 remain stationary. In this way, the handle 16 may be moved to the back edge 49 and the weak first spring 40 is permitted to adjust the position of the clutch positioning device 130 to the various thickness of the ears. The first spring 40 should preferably be sufficiently stiff so that the clutch positioning device 130 is firmly held against the ear 129.

The ear 129 is now ready to be pierced. The trigger portion 54 is pulled upwardly by the operator which forces the pointer 98 to engage the threaded portion 106 to lock the clutch positioning device 130 in the closed position. It is important that the clutch positioning device 130 is firmly locked before the push rod assembly 60 is released so that the clutch 122 may safely receive the ear piercing pin 112 without changing the position of the clutch positioning device upon impact of the ejected ear piercing pin. In this way, the clutch 122 is correctly attached on the ear piercing pin 112 at a distance that is always adjusted to the thickness of the ear 129. It is to be understood that the second released position of the push rod 60 is independent of the thickness of the ear. If the ear 129 is thin, the clutch 122 will therefore be attached further in on the ear piercing pin 112. If the ear 129 is thick, the clutch 122 will be attached further out on the ear piercing pin 112.

As mentioned earlier, when the handle 16 is pulled to the back edge 49, the inner opening 104 is aligned with the locking mechanism 76 so that the threaded portion 106 is accessible to the pointer 98. The trigger portion 54 is further pulled upwardly until the engaging portion 56 disengages and releases the head portion 58 of the push rod assembly 60. It is important to note that the pointer 98 engages the threaded portion 106 before the push rod assembly 60 is released so that the clutch assembly 14 is in a locked position relative to the stationary portion 131 of the cartridge 13 prior to releasing the rod member 72. If the cylindrical member 19 is not locked into a locked position, the clutch positioning device 130 and thus the clutch 122 may move outwardly from the impact of the piercing pin 112 penetrating the ear and engaging the clutch 122 because the first spring 40 may be relatively weak and may allow the cylindrical member 19 to move slightly relative to the handle 16. This is undesirable because the clutch 122 may be attached too far out on the ear piercing pin 112.

When the head portion 58 is released, the cavity 69 of the rod member 72 is permitted to engage the protruding engaging section 118 of the holder device 107 to push the holder device 107 towards the clutch assembly 14 that is in the locked position by the pointer 98 of the locking mechanism 76. The holder device 107 is rapidly pushed forward by the rod member 72 until the jaws 120 hit the chamfered jaw engaging surfaces 124 and the piercing pin 112 engages the clutch 122. It is important to note that the piercing pin 112 and the enlarged portion 110 are firmly held within the holder device 107 while the jaws 120 are in the closed position. The firm holding of the holder device 107 permits the use of fragile materials for the piercing pin 112 and the enlarged portion such as gold and other fragile metals. The jaw engaging surfaces 124 forces the jaws 120 to open so that the piercing pin 112 including the enlarged portion 110 may be removed from the holder device 107.

Due to the relatively weak biasing force of the first spring 40, the position of the clutch positioning device 130 is automatically adjusted to the thickness of the ear 129 prior to ejection of the rod member 72 although the handle 16 is always pulled all the way back to the back edge 49 of the slit opening 46. In other words, the attachment position of the clutch 122 is automatically adjusted on the ear piercing pin 112 to accommodate a wide variety of ear thicknesses to ensure that the ear piercing pin 112 is not attached too tightly or loosely. The adjustment and the piercing are independent upon the hand strength of the operator making the ear piercing apparatus easy and safe to use. However, by locking the cylindrical member 19 with the locking mechanism 76, the clutch positioning device 130 cannot move relative to the rod member 18 when the piercing pin 112 is ejected and the clutch 122 is firmly held in a position to safely receive the piercing pin 112. When the piercing of the ear is completed, the push rod is pulled back to the first position and the holder device is movable with the push rod when the push rod is moved from the second position to the first position. Before the push rod reaches its first position, the holder device engages the cassette. When the push rod is moved further towards the first position, the holder device becomes releasably held within the cassette and the entire cassette assembly, including the holder device, can be easily and hygienically removed from the cartridge housing.

In an alternative embodiment, it may not be necessary to have a handle. For example, if a push rod that is not spring-biased is used, the operator may use his/her hand strength to force the piercing pin through the ear into the clutch. The clutch positioning device is first put into the desired position depending upon the thickness of the ear, the desired position is then locked so that the push rod can be urged forwardly until the ear is pierced and the clutch is correctly positioned on the piercing pin.

While the present invention has been described in accordance with preferred compositions and embodiments, it is to be understood that certain substitutions and alterations may be made thereto without departing from the spirit and scope of the following claims.

I claim:

1. An ear piercing apparatus, comprising:

an ear piercing pin having an enlarged head portion;

a holder device holding the enlarged head portion of the ear piercing pin, the holder device having a front portion and a rear portion, the rear portion having a push rod engaging section, the front portion having jaws that are movable between a closed position and an open position, the ear piercing pin being firmly held inside the holder device when the jaws are in the closed position and the ear piercing pin being releasably held within the holder device when the jaws are in the open position;

a cartridge housing releasably supporting a cartridge, the cartridge having a chamfered jaw engaging surface for engaging and opening the jaws of the holder device when the holder device is shifted towards the chamfered jaw engaging surface;

a clutch adapted to engage the ear piercing pin;

a clutch assembly releasably supporting the clutch;

a clutch positioning device movable from a first position to a second position to urge an ear against the cartridge when the clutch positioning device is in the second position, the first position being different from the second position;

an elongate push rod being movable between a first position and a second position; and an elongate guide member attached to the clutch positioning device.

2. The ear piercing apparatus according to claim 1 wherein the ear piercing apparatus further comprises a handle operatively attached to a bar member and the clutch positioning device is in the open position when the handle is in a forward position, the clutch positioning device is in the closed position in contact with the ear when the handle is in an intermediate position, the clutch positioning device remains in the closed position when the handle is moved from the intermediate position to a rearward position so that the guide member remains stationary relative to the second position of the push rod as the handle is moved rearwardly, the intermediate position is disposed between the forward position and the rearward position.

3. The ear piercing apparatus according to claim 2 wherein the handle is movable relative to the push rod when the push rod is in the first position.

4. The ear piercing apparatus according to claim 1 wherein the elongate guide member has a first spring attached thereto.

5. The ear piercing apparatus according to claim 4 wherein the elongate bar member is slidably attached to the guide member, the bar member has a second spring attached thereto.

6. The ear piercing apparatus according to claim 5 wherein the guide member is connected to the clutch positioning device so that the clutch positioning device is movable relative to the elongate bar member.

7. The ear piercing apparatus according to claim 1 wherein the holder device has a protruding back wall and the push rod has an outer end having a cavity defined therein that is adapted to receive the protruding back wall of the holder device.

8. The ear piercing apparatus according to claim 2 wherein the handle is movable relative to the elongate guide member.

9. The ear piercing apparatus according to claim 1 wherein the push rod is spring loaded.

10. The ear piercing apparatus according to claim 1 wherein the holder device is movable with the push rod when the push rod is moved from the second position to the first position.

11. The ear-piercing apparatus according to claim 10 wherein the holder device is releasably held within the cartridge when the push rod is in the second position and the holder device is non-releasably held within the cartridge when the push rod is in the first position.

* * * * *